US009363872B2

(12) United States Patent
Toyooka

(10) Patent No.: US 9,363,872 B2
(45) Date of Patent: Jun. 7, 2016

(54) DISPLAY DEVICE AND METHOD OF CONTROLLING LIGHT SOURCE

(71) Applicant: SEIKO EPSON CORPORATION, Tokyo (JP)

(72) Inventor: Takashi Toyooka, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 338 days.

(21) Appl. No.: 13/975,657

(22) Filed: Aug. 26, 2013

(65) Prior Publication Data

US 2014/0062328 A1 Mar. 6, 2014

(30) Foreign Application Priority Data

Aug. 30, 2012 (JP) ..... 2012-189864

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 37/0281* (2013.01); *H05B 33/0866* (2013.01)

(58) Field of Classification Search

CPC .... H05B 41/38; H05B 39/04; H05B 33/0866; H05B 37/02; H05B 41/36

See application file for complete search history.

(56) References Cited

U.S. PATENT DOCUMENTS 8,870,387 B2 * 10/2014 Toyooka ..... G03B 21/2033 313/498

2005/0007306 A1 1/2005 Ilsaka et al.

FOREIGN PATENT DOCUMENTS

| | | |
|---|---|---|
| JP | A-2004-302254 | 10/2004 |
| JP | A-2004-354717 | 12/2004 |

* cited by examiner

*Primary Examiner* — Hai L Nguyen

(74) *Attorney, Agent, or Firm* — Oliff PLC

(57) ABSTRACT

The display device includes a light source, and a control section adapted to generate a composite pulse width modulation signal using PWM1 having a first Duty ratio and PWM2 having a frequency higher than the frequency of PWM1, and control a light emitting state of the light source using the composite pulse width modulation signal. The control section corrects a second Duty ratio based on a difference between an expected value of luminance obtained when making the light source emit light using a virtual pulse width modulation signal, which is obtained by combining PWM1 and a pulse width modulation signal having the second Duty ratio, and a setting value of luminance based on the information related to the luminance of the light source, and then uses the second Duty ratio corrected as the Duty ratio of PWM2.

7 Claims, 11 Drawing Sheets

DISPLAY DEVICE AND METHOD OF CONTROLLING LIGHT SOURCE

The entire disclosure of Japanese Patent Application No. 2012-189864, filed Aug. 30, 2012, is expressly incorporated by reference herein.

BACKGROUND

1. Technical Field

The present invention relates to a display device and a method of controlling a light source.

2. Related Art

In display devices, there has been known a technology of intermittently lighting (hereinafter referred to as "intermittent illumination" in some cases) a light source to thereby display an image. For example, by inserting a black screen in one frame, it is possible to reduce the afterimage felt by the user to thereby achieve improvement of the animation performance (see, e.g., JP-A-2004-302254 (Document 1), JP-A-2004-354717 (Document 2)). Further, it has been known that in the display device adopting an active-shutter system to thereby perform 3D display, in the case of switching, for example, from the display image for the right eye to the display image for the left eye, the crosstalk between the right eye and the left eye can effectively be prevented by performing black display using the intermittent illumination.

Further, the intermittent illumination is also used for the purpose of regulating the luminance (dimming the light) by controlling the lighting time per unit time besides the purpose of inserting the black screen in the frame as described above. Such dimming control is known as pulse width modulation (PWM) dimming.

In the display device, in the case of adopting the intermittent illumination for the two purposes (e.g., the insertion of a black image and the dimming control), a control section for controlling drive of the display device combines two drive signals corresponding respectively to the purposes with each other to generate a new drive signal (hereinafter referred to as a "composite drive signal" in some cases), and controls the light source using the composite drive signal. The combination of the new drive signal is performed by, for example, a logical AND operation of the two drive signals.

In this case, in order to change (e.g., the luminance) one of the two drive signals, it is necessary to also change the composite drive signal in accordance with the drive signal thus changed. It can be realized by, for example, a control section having the correspondence relationship between the one drive signal and the composite drive signal as a look-up table (LUT), and performing the control with the LUT. However, in this case, a plurality of LUT is necessary, and there is a problem that a circuit load is increased, and at the same time, the time for changing the setting is also increased.

SUMMARY

An advantage of some aspects of the invention is to provide a display device capable of easily controlling the drive conditions of the intermittent illumination. Another advantage of some aspects of the invention is to provide a method of controlling a light source capable of easily performing the control of the drive condition of the intermittent illumination.

A display device according to an aspect of the invention includes a light source, and a control section adapted to generate a composite pulse width modulation signal using a first pulse width modulation signal having a first duty ratio and a second pulse width modulation signal having a frequency higher than a frequency of the first pulse width modulation signal, and control a light emitting state of the light source using the composite pulse width modulation signal, and the control section corrects a second duty ratio, which is obtained based on a correspondence relationship between information related to luminance of the light source and a duty ratio of a pulse width modulation signal of the light source, based on a difference between an expected value of luminance obtained when making the light source emit light using a virtual pulse width modulation signal, which is obtained by combining the first pulse width modulation signal and a pulse width modulation signal having the second duty ratio, and a setting value of luminance based on the information related to the luminance of the light source, and then obtains the second duty ratio corrected as a duty ratio of the second pulse width modulation signal.

According to this configuration, even in the case in which the setting of the light source is changed and thus the duty ratio of the second pulse width modulation signal is changed, it is possible to correct the luminance of the image obtained using the second duty ratio corrected in accordance with the information related to the luminance of the light source. Therefore, it is possible to provide a display device capable of easily controlling the drive condition of the intermittent illumination.

In the display device according to the aspect of the invention, it is preferable that the light source includes a first light source and a second light source, and the control section performs a calculation of correcting a difference in light source output between the first light source and the second light source in a case of making the first light source and the second light source emit light in a same condition.

According to this configuration, in the case in which a plurality of light sources is different from each other in the emission characteristics, the luminance correction can appropriately be performed, and therefore, the plurality of light sources different in characteristics from each other can be treated as equivalent, and thus the drive condition can easily be controlled.

In the display device according to the aspect of the invention, it is preferable that the frequency of the second pulse width modulation signal is an integral multiple of the frequency of the first pulse width modulation signal.

According to this configuration, blinking of light at the low frequency corresponding to the beat frequency of the first pulse width modulation signal and the second pulse width modulation signal can be prevented from occurring.

In the display device according to the aspect of the invention, it is preferable that the control section obtains the second duty ratio using a look-up table representing the correspondence relationship.

According to this configuration, the calculation process is simplified.

In the display device according to the aspect of the invention, it is preferable that the control section calculates correction information adapted to correct a difference between the expected value and the setting value using the first duty ratio and the second duty ratio, and corrects the second duty ratio using the correction information.

According to this configuration, even in the case in which the setting of the light source is changed, and thus, the duty ratio of the second pulse width modulation signal is changed, the appropriate correction information can be obtained by a simple calculation on a case-by-case basis, and thus, it is possible to correct the luminance of the image obtained.

In the display device according to the aspect of the invention, it is preferable that the control section calculates correction information adapted to correct a difference between the expected value and the setting value using the first duty ratio and the second duty ratio, corrects the look-up table using the correction information, and obtains a duty ratio of the second pulse width modulation signal, which is the second duty ratio corrected, using the look-up table corrected.

According to this configuration, even in the case in which the light source luminance information is updated, by looking up the look-up table thus corrected, the duty ratio of the second pulse width modulation signal as the target can easily be obtained without recalculating the correction information.

A method of controlling a light source according to another aspect of the invention is a method of controlling a light source adapted to control a light emitting state of the light source using a composite pulse width modulation signal, which is generated using a first pulse width modulation signal having a first duty ratio and a second pulse width modulation signal having a frequency higher than a frequency of the first pulse width modulation signal, the method including correcting a second duty ratio, which is obtained based on a correspondence relationship between information related to luminance of the light source and a duty ratio of a pulse width modulation signal of the light source, based on a difference between an expected value of luminance obtained when making the light source emit light using a virtual pulse width modulation signal, which is obtained by combining the first pulse width modulation signal and a pulse width modulation signal having the second duty ratio, and a setting value of luminance based on the information related to the luminance of the light source, and obtaining the second duty ratio corrected as a duty ratio of the second pulse width modulation signal.

According to this configuration, it is possible to easily correct the luminance of the image obtained using the duty ratio corrected in accordance with the information related to the luminance of the light source.

BRIEF DESCRIPTION OF THE DRAWINGS

The invention will be described with reference to the accompanying drawings, wherein like numbers reference like elements.

DESCRIPTION OF AN EXEMPLARY EMBODIMENT

Figure 1:
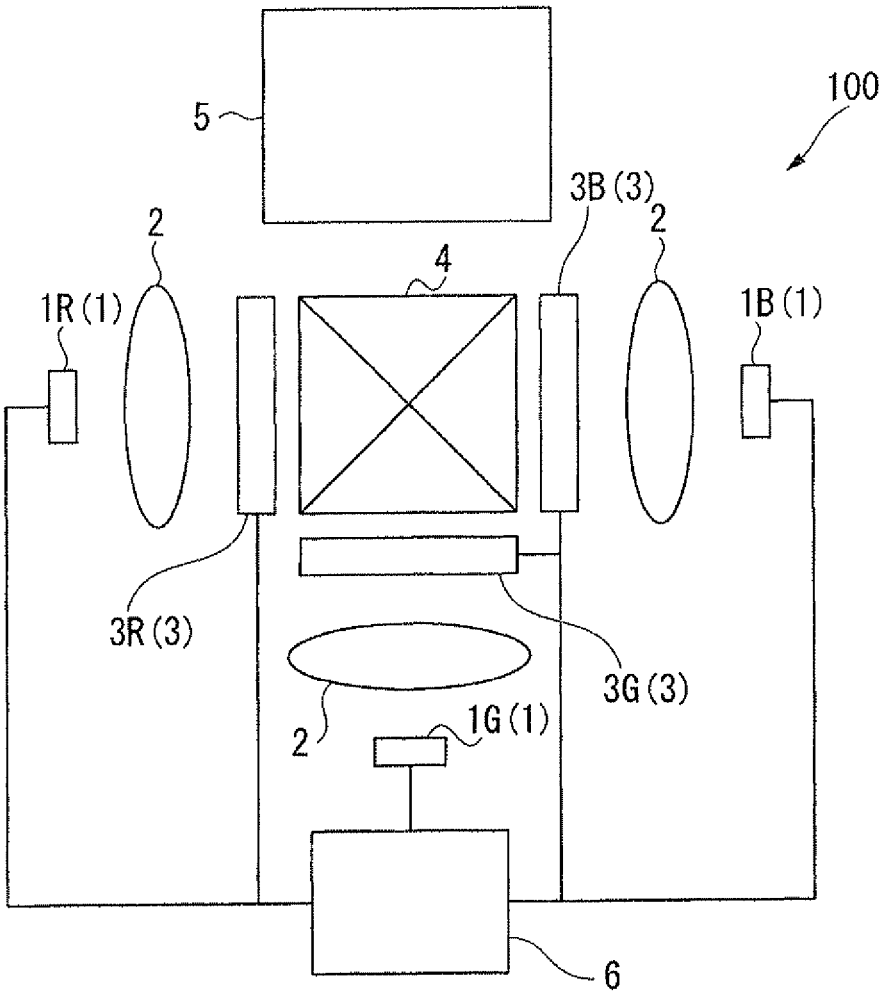
FIG. 1 is a schematic diagram showing a projector according to an embodiment of the invention.

Hereinafter, a projector (a display device) according to an embodiment of the invention will be explained with reference to FIGS. 1 through 11. The projector according to the present embodiment adopts a configuration of controlling a light source using the pulse width modulation. It should be noted that in all of the drawings described below, the sizes and the ratios between the sizes of the constituents are arbitrarily made different from each other in order to make the drawings eye-friendly.

In the following explanation, "light source output" denotes the light, intensity obtained when making the light source emit light with a predetermined voltage without performing the pulse width modulation in one cycle of the drive signal (the pulse width modulation signal) used when performing the pulse width modulation.

Further, a "duty ratio (Duty ratio)" denotes the proportion of the ON period in one cycle of the pulse width modulation signal. The unit of the duty ratio is "%."

Further, "luminance" denotes the light intensity obtained in one cycle of the pulse width modulation signal when making the light source emit light at the "light source output" described above using the pulse width modulation. In other words, the "luminance" denotes the light intensity actually emitted from the light source performing the pulse width modulation, and is a value obtained from the product of the "light source output" and the "Duty ratio" in one cycle.

Further, the "light source luminance information" denotes the information, which is related to the luminance of the light source, and is for regulating the duty ratio.

For example, in the case of regulating the luminance in accordance with the image signal, the "light source luminance information" includes the grayscale value of the image signal. It should be noted that the "grayscale value" is the information provided to the image signal input to the projector, and represents the gradation of the luminance from a bright section of the image to a dark section thereof defined for each of the pixels of the image to be displayed.

Further, in the case in which the user regulates the luminance from a menu screen of the projector, the "light source luminance information" includes the output value of the light source thus set.

Further, in the case in which the user selects one of color modes from the menu screen of the projector, the "light source luminance information" includes a setting value of the luminance set in advance for each of the alternative items for the color mode. It should be noted that the "color mode" denotes each of the alternative items for regulating the image quality in accordance with the type of the image, viewing environment, and so on. As the alternative items, there can be cited, for example, "dynamic" suitable for viewing in a bright environment, "living" suitable for viewing in the half-light, "natural" capable of reproducing an image faithful to the input signal under the dark environment, and "theater" suitable for movie appreciation under the dark environment. The user can select the color mode corresponding to the image, the viewing environment, and so on out of these alternative items. Further, in the alternative items, a parameter of each the regulation items of "luminance of the image," "contrast," "color depth," "color," and "sharpness" is expressed with a numerical value, and the degree thereof can be regulated by increasing or decreasing the parameter within a predetermined range.

The setting values determined in accordance with the grayscale value or the color mode are integrated by multiplication, and thus, the "light source luminance information" is obtained.

In the projector performing the pulse width modulation, the "Duty ratio" is obtained based on the "light source luminance information" of the image signal input thereto, the pulse width modulation signal is generated using the "Duty ratio" and a voltage applied to the light source, and by inputting the pulse width modulation signal to the light source, the image with the "luminance" set in accordance with the "light source luminance information" is displayed. In the projector according to the present embodiment, although the details will be described later, there is provided a control section for correcting the difference between the "luminance" of the light emitted based on the "light source luminance information" and the setting value of the "luminance" set based on the "light source luminance information." Hereinafter, the explanation thereof will sequentially be presented.

FIG. 1 is a schematic diagram showing the projector according to the present embodiment. As shown in the drawing, the projector 100 of the present embodiment includes a light source section (a light source) 1, a collimating optical system 2 for collimating the light emitted from the light source section 1, a light modulation device 3, to which the light emitted through the collimating optical system 2 is input, and which modulates the light (the incident light), a light path combining element 4 for combining the light modulated by the light modulation device 3 to thereby form an image light, a projection optical system 5 for projecting the image light, and a control section (a control device) 6 for controlling the drive of the light source section 1 and the light modulation device 3.

The light source section 1 includes a first light source 1R for emitting a red light, a second light source 1G for emitting a green light, and a third light source 1B for emitting a blue light. The red light, the green light, and the blue light are an example of a typical combination of element colors for displaying a full-color image.

The first light source 1R, the second light source 1G, and the third light source 1B are each a solid-state light source, and for example an LED, an organic or inorganic semiconductor laser element, and an organic electroluminescent (EL) element can be used therefor. Further, it is also possible to use a light source device having an LED or a laser, and a fluorescent material for absorbing the light emitted from the light source and then emitting fluorescence.

It should be noted that although the light source section 1 of the present embodiment has the three light sources corresponding respectively to the three different element colors, the light source section 1 can also be configured including the light sources corresponding respectively to four or more different element colors, or can also be configured including the light sources corresponding respectively to two different element colors. Further, although the drawing shows the single first light source 1R, the single second light source 1G, and the single third light source 1B, each of the light sources can also be a light source array having a plurality of light sources integrated with each other.

The collimating optical system 2 collimates the lights emitted from the light source section 1, and then emits the lights thus collimated toward the light modulation device 3. The collimating optical system 2 can be configured including a single optical element such as a lens or a diffractive element, or can also be configured including a plurality of optical elements combined with each other.

It should be noted that on the light paths between the collimating optical system 2 and the light modulation device 3, there can be disposed integrators each for averaging the light intensity distribution in a plane perpendicular to the light path, and polarization conversion elements for emitting the lights emitted from the collimating optical system 2 while making the polarization states of the lights the same as each other, namely either one of the P-polarized light and the S-polarized light.

As the light modulation device 3, liquid crystal light valves or Digital Mirror Device (DMD), for example, can be used. In the drawing, the light modulation device 3 includes a first liquid crystal light valve 3R for modulating the red light, a second liquid crystal light valve 3G for modulating the green light, and a third liquid crystal light valve 3B for modulating the blue light. As the light modulation device 3, transmissive liquid crystal light valves, for example, can be adopted. The liquid crystal light valves each include a pair of polarization plates and a liquid crystal panel positioned between the pair of polarization plates, and each modulate the incident light, which is emitted from the light source section 1 and enters the liquid crystal light valve, pixel by pixel based on the image signals supplied from the control section 6.

The light path combining element 4 is formed of a dichroic prism or the like. The dichroic prism has a structure having four triangular prisms bonded to each other. The surfaces of the triangular prisms bonded to each other form internal surfaces of the dichroic prism. A mirror surface for reflecting the red light and transmitting the green light and the blue light and a mirror surface for reflecting the blue light and transmitting the green light and the red light are formed orthogonally to each other in the internal surfaces of the dichroic prism. The green light having entered the dichroic prism passes through the mirror surfaces, and is emitted directly. The red light and the blue light having entered the dichroic prism are selectively reflected or transmitted by the mirror surfaces, and then emitted in the same direction as the emission direction of the green light.

The light (the image light) combined by the light path combining element 4 is projected on a projection surface via the projection optical system 5 in an enlarged manner.

Figure 2:
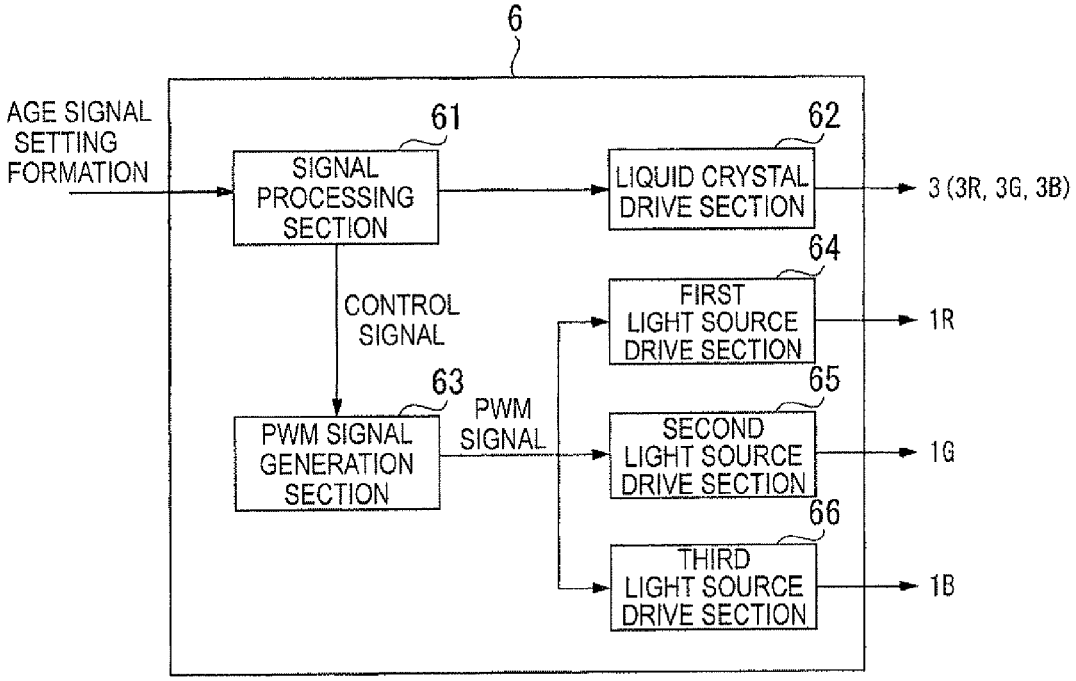
FIG. 2 is a configuration diagram of a control section provided to the projector according to the embodiment.

FIG. 2 is a configuration diagram of the control section 6. The control section 6 controls the drive of the light source section 1 and the light modulation device 3. The image signal externally input to the control section 6 includes the drive signal for the light modulation device 3 and the drive signal for the light source section 1. The drive signal for the light modulation device 3 out of the image signal on which an image quality regulation and a color regulation are performed by a signal processing section 61 is then input to a liquid crystal drive section 62. The liquid crystal drive section 62 supplies the light modulation device 3 with the drive signal.

On the other hand, in the signal processing section 61, the light source output, the Duty ratio of the intermittent illumination, and so on are set based on the light source luminance information obtained using the color mode setting, the gray-scale values included in the image signal, and so on, and then the settings are input to a PWM signal generation section 63.

The PWM signal generation section 63 generates a PWM signal (a pulse width modulation signal) for controlling the emission state of each of the light sources (the first light source 1R, the second light source 1G, and the third light source 1B) based on the control signal (the value of the light source output and the Duty ratio) input to the PWM signal generation section 63. The PWM signals to be generated are supplied to the first light source 1R, the second light source 1G, and the third light source 1B via a first light source drive section 64, a second light source drive section 65, and a third light source drive section 66, respectively.

Here, the projector 100 according to the present embodiment has a configuration of performing the intermittent illumination different between two purposes, and the control signal input to the PWM signal generation section 63 includes a signal for controlling the lighting time of the light source in accordance with the two intermittent illumination modes. For example, the control signal input to the PWM signal generation section 63 includes information (intermittent lighting information) related to the intermittent illumination for intermittently lighting each of the light sources to thereby insert a black image, and the light source luminance information.

In the projector of the related art, in the case in which the two intermittent illumination modes exist in a mixed manner as described above, the PWM signal is set for each of the intermittent lighting information and the light source luminance information. In the following explanation, the PWM signal related to the intermittent lighting information is referred to as a first PWM signal (a first pulse width modulation signal; hereinafter referred to as "PWM1" in some cases), and the PWM signal related to the light source luminance information is referred to as a second PWM signal (a second pulse width modulation signal; hereinafter referred to as "PWM2" in some cases). The second PWM signal is a signal having a frequency higher than that of the first PWM signal. The first PWM signal and the second PWM signal respectively have the frequencies and the Duty ratios set individually.

Further, the combined PWM signal is obtained by the logical AND between the PWM1 and PWM2. In the case of controlling the light source using the PWM signal combined by such a process as described above, the following problem arises.

Figure 3:
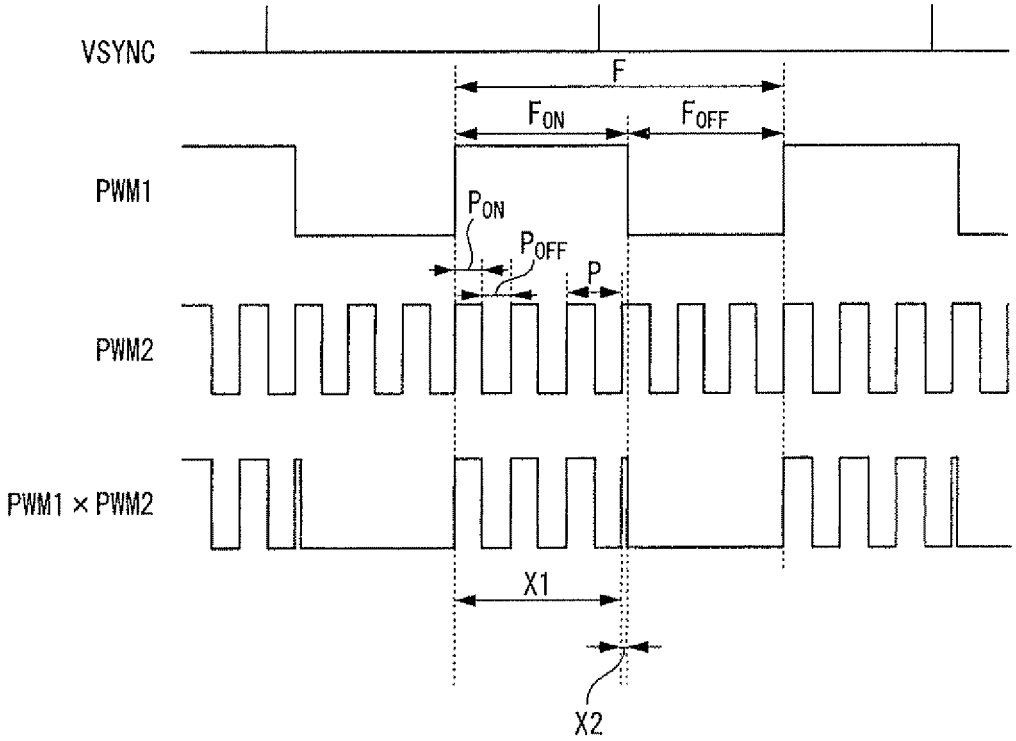
FIG. 3 is a timing chart of the projector according to the embodiment.

FIG. 3 is a timing chart of the projector performing two types of intermittent illumination. In the drawing, "VSYNC" denotes a vertical sync signal of the image.

"PWM1" denotes a PWM signal for controlling light time $F_{ON}$ and extinction time $F_{OFF}$ in one frame F. The Duty ratio of PWM1 is referred to as a "first Duty ratio (first duty ratio)" in some cases.

"PWM2" denotes a PWM signal for controlling an ON period $P_{ON}$ and an OFF period $P_{OFF}$ for making the light source emit the light with the desired luminance. The Duty ratio of PWM2 is referred to as a "second Duty ratio" in some cases.

"PWM1×PWM2" denotes a PWM signal obtained by the logical AND operation using PWM1 and PWM2.

In the drawing, the timing is shown assuming that the frequency of PWM2 is six times of the frequency of PWM1. By setting the frequency of PWM2 to an integral multiple of the frequency of PWM1, blinking of light at the low frequency corresponding to the beat frequency of PWM1 and PWM2 can be prevented from occurring. For example, the frequency of VSYNC and PWM1 is 120 Hz, and the frequency of PWM2 is 720 Hz, which is six times of 120 Hz.

In the drawing, it is assumed that there is adopted the configuration in which the rising edge of PWM1 and the rising edge of PWM2 are in sync with each other. It should be noted that there is adopted the configuration in which the lighting time $F_{ON}$ of PWM1 is not integral multiple of the period P (the inverse of the frequency) of PWM2.

In such a timing chart, the lighting time $F_{ON}$ of "PWM1×PWM2" is composed of a period (indicated by the reference symbol X1 in the drawing) including three cycles of the ON period $P_{ON}$ and the OFF period $P_{OFF}$ in PWM2, and a period (indicated by the reference symbol X2 in the drawing) following the period X1 and including a part of the ON period $P_{ON}$ in PWM2.

In this case, in the lighting period $F_{ON}$ in "PWM1×PWM2," although the pulse width modulation corresponding to the Duty ratio defined by PWM2 is performed in the period X1, the pulse width modulation corresponding to the Duty ratio defined by PWM2 is not achieved in the period X2. In FIG. 3, an always-on state is set in the period X2. As a result, the Duty ratio in the lighting time $F_{ON}$ of "PWM1×PWM2" fails to coincide with the Duty ratio of PWM2.

Therefore, in the projector of the related art, it is not achievable to perform the image display corresponding to the light source luminance information. In the example shown in FIG. 3, since the always-on state is set in the period X2, it results that the image brighter than the setting by PWM2 is displayed as a whole of the lighting time $F_{ON}$.

Such a difference between the luminance (the setting value) defined by PWM2 and the luminance of the image actually displayed is caused since the lighting time $F_{ON}$ of PWM1 fails to be an integral multiple of the period of PWM2, and the period corresponding to the period X2 occurs. In other words, the difference is caused since the Duty ratio of PWM2 fails to coincide with the Duty ratio in the lighting time $F_{ON}$ of "PWM1×PWM2." Therefore, when the lighting time $F_{ON}$ of PWM1 is changed, the length of the period X2 is changed, and thus, the deviation amount of the luminance deviation caused in the case of using "PWM1×PWM2" is also changed as described above.

To cope with such an assumed problem, by previously preparing an LUT, which is corrected so that the difference between the luminance defined by PWM2 and the luminance of the image actually displayed does not occur, for each of the setting values of PWM1, it is possible to resolve the luminance deviation described above. However, such a configuration of previously preparing a plurality of LUT as described above increases the circuit load, and at the same time increases the time required to change the setting of PWM1.

In contrast, in the projector 100 according to the present embodiment, it is arranged that the signal processing section 61 and the PWM signal generation section 63 shown in FIG. 2 obtain the correction information for correcting the luminance deviation by calculation.

Hereinafter, assuming that the image signal input thereto provides the frequency, the Duty ratio, and the length of the lighting time $F_{ON}$ of PWM1 as the intermittent lighting information, the method of controlling the light source performed by the signal processing section 61 and the PWM signal generation section 63 will be explained.

Figure 4:
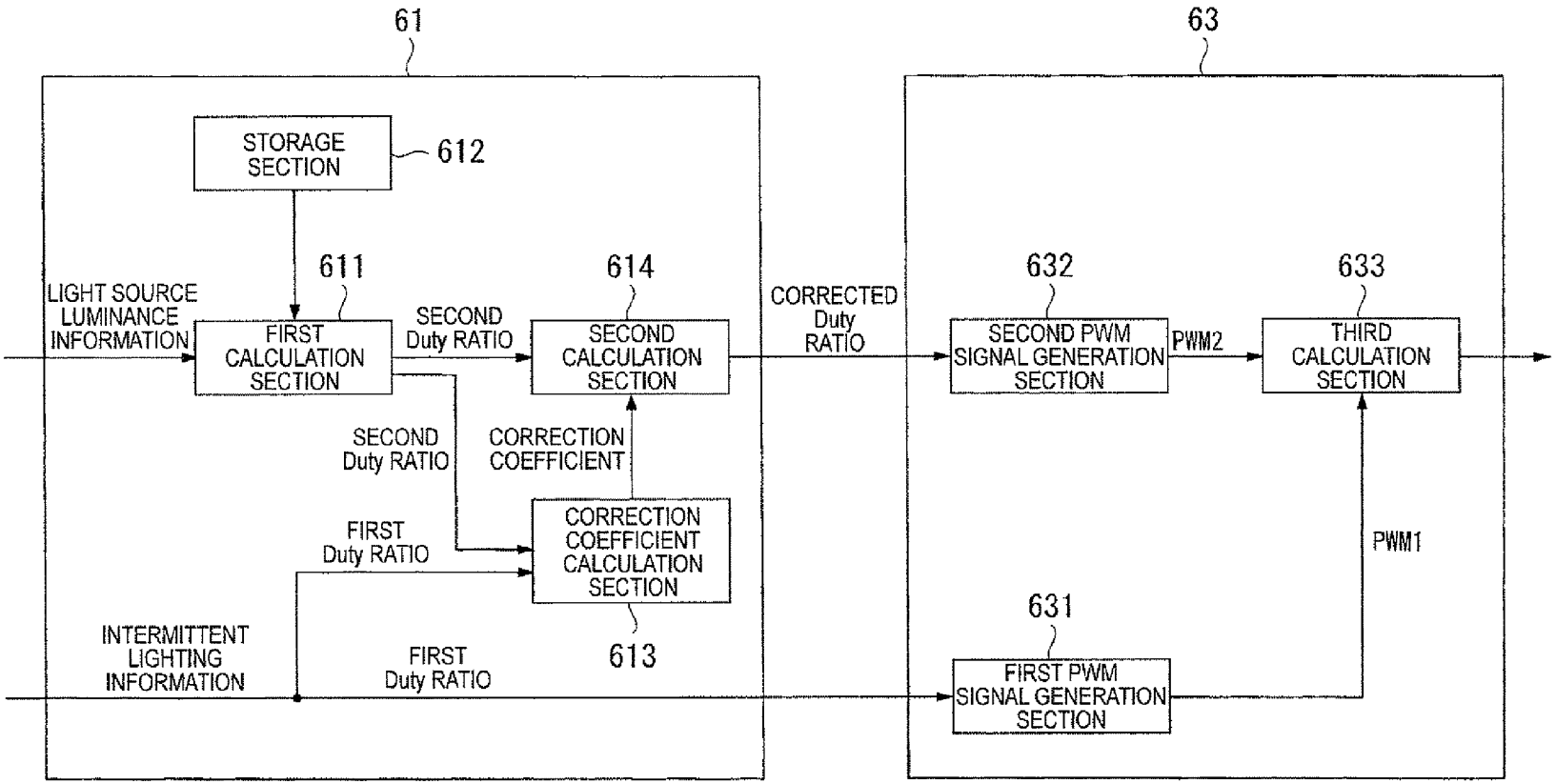
FIG. 4 is a configuration diagram of a PWM signal generation section.

FIG. 4 is a configuration diagram of the signal processing section 61 and the PWM signal generation section 63. The signal processing section 61 has a first calculation section 611, a storage section 612, a correction coefficient calculation section 613, and a second calculation section 614. Further, the PWM signal generation section 63 has a first PWM signal generation section 631, a second PWM signal generation section 632, and a third calculation section 633.

The light source luminance information input to the signal processing section 61 is input to the first calculation section 611. In the first calculation section 611 obtains a virtual value (a second duty ratio) of the Duty ratio of the light source based on the value of the known light source output and the light source luminance information input thereto.

In the projector 100 according to the present embodiment, the storage section 612 stores the LUT representing the correspondence relationship between the light source luminance information and the Duty ratio of the PWM signal of the light source for each of the values of the light source output, and it is arranged that the first calculation section 611 obtains the second Duty ratio from the light source luminance information based on the LUT. According to such a configuration, the calculation process is simplified. Further, it is also possible to assume that the storage section 612 stores a function representing the correspondence relationship between the light source luminance information and the Duty ratio of the light source instead of the LUT.

Further, the light sources (the first light source 1R, the second light source 1G, and the third light source 1B) used are different from each other in some cases in the difference of the light source output when emitting the light in the same conditions due to the influence of the difference in the light to be emitted, and various factors such as the drive temperature or response characteristics of the drive circuit. It is also possible to arrange that the storage section 612 stores the correction coefficients for correcting such differences as LUT or functions, and the first calculation section 611 performs the calculation for the correction. Thus, in the case in which a plurality of light sources is different from each other in the emission characteristics, the luminance correction can appropriately be performed, and therefore, the plurality of light sources different in characteristics from each other can be treated as equivalent, and thus the drive condition can easily be controlled.

The correction coefficient calculation section 613 calculates a correction coefficient (correction information) for correcting the luminance deviation (the difference between the expected value of the luminance and the setting value thereof) caused by the light emission in the period X2 shown in FIG. 3 using the first Duty ratio and the second Duty ratio.

Hereinafter, the explanation will be presented assuming that "PWM2" shown in FIG. 3 represents a pulse width modulation signal having the second Duty ratio described above. Further, the explanation will be presented assuming that "PWM1×PWM2" shown in FIG. 3 corresponds to a virtual pulse width modulation signal (a virtual PWM) according to the present invention.

The correction coefficient calculation section 613 first assumes PWM1×PWM2 (the virtual PWM) obtained by combining the PWM1 and the pulse width modulation signal having the second Duty ratio, and then obtains "the Duty ratio at which the difference between the expected value of the luminance obtained when making the light source emit light using the virtual PWM and the setting value of the luminance based on the light source luminance information becomes the largest" (hereinafter referred to as an inflection-point Duty ratio), and "the luminance at which the deviation amount of the luminance becomes the largest" (hereinafter referred to as an inflection-point luminance).

In the calculation of the [inflection-point Duty ratio], the remainder when dividing the "length of the lighting time $F_{ON}$" (hereinafter referred to as an $F_{ON}$ length) by the "period of PWM2" (hereinafter referred to as a PWM2 period) is obtained first. The remainder corresponds to the "length of the period X2" (hereinafter referred to as an X2 length) shown in FIG. 3. When the [X2 length] coincides with the "length of the ON period $P_{ON}$ per cycle of PWM2" (hereinafter referred to as a $P_{ON}$ length), the deviation amount of the luminance caused at the Duty ratio of PWM2 becomes the largest.

Since the [$P_{ON}$ length] corresponds to the product of the [PWM2 period] and the Duty ratio of PWM2, the "inflection-point Duty ratio" can be obtained as the value (Formula (1) below) obtained by dividing the [X2 length] (i.e., the [$P_{ON}$ length]) by the [PWM2 period].

$$\text{Inflection-point Duty ratio} = \frac{X2\ \text{length}}{PWM2\ \text{period}} = \frac{P_{ON}\ \text{length}}{PWM2\ \text{period}} \tag{1}$$

In the calculation of the [inflection-point luminance], the "number of times of the ON period $P_{ON}$ of PWM2 in the lighting time $F_{ON}$" (hereinafter referred to as an ON frequency) is obtained first. The [ON frequency] can be obtained as a value obtained by rounding up the value (Formula (2) below), which is obtained by dividing the [$F_{ON}$ length] by the [X2 length] (i.e., the [$P_{ON}$ length]), to an integer. It should be noted that the [$F_{ON}$ length] corresponds to the product of the "period of PWM1" (hereinafter referred to as a PWM1 period) and the Duty ratio of PWM1.

$$ON\ \text{frequency} = \frac{[PWM1\ \text{period}] \times [\text{Duty ratio of } PWM1]}{X2\ \text{length}} = \frac{F_{ON}\ \text{length}}{P_{ON}\ \text{length}} \tag{2}$$

Subsequently, the [ON frequency] obtained as a value obtained by rounding up the value of Formula (2) above to an integer is multiplied by the [$P_{ON}$ length] to thereby obtain a "total amount of the ON period $P_{ON}$ in the lighting time $F_{ON}$" (hereinafter referred to as an ON total) (Formula (3) below).

$$\text{ON total} = [\text{ON frequency}] \times [P_{ON}\ \text{length}] \tag{3}$$

Then, by dividing the value obtained by Formula (3) described above by the [$F_{ON}$ length], a "Duty ratio in the lighting time $F_{ON}$ of the virtual PWM" (hereinafter referred to as a virtual PWM Duty ratio) can be obtained (Formula (4) below).

$$\text{Virtual } PWM \text{ Duty ratio} = \frac{ON\ \text{total}}{F_{ON}\ \text{length}} \tag{4}$$

The [inflection-point luminance] can be obtained by multiplying the [virtual PWM Duty ratio] obtained by Formula (4) described above by the light source output, which is a fixed value (Formula (5) below).

$$\text{Inflection-point luminance} = [\text{virtual PWM Duty ratio}] \times [\text{light source output}] \tag{5}$$

Figure 5A:
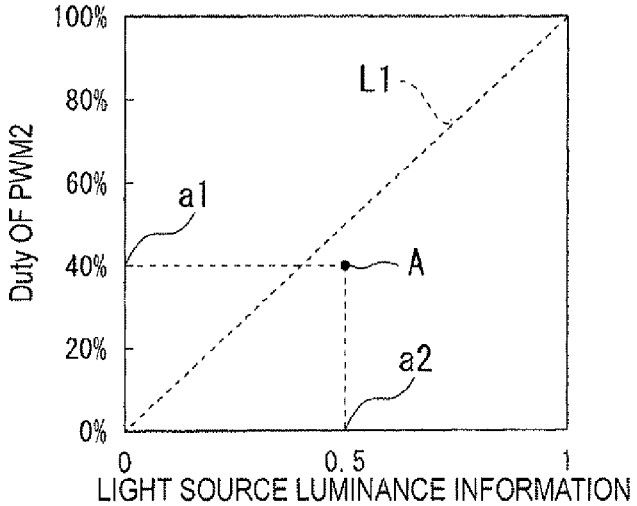
FIGS. 5A through 5C are graphs showing an example of a calculation process for obtaining a correction coefficient.
Figure 5B:
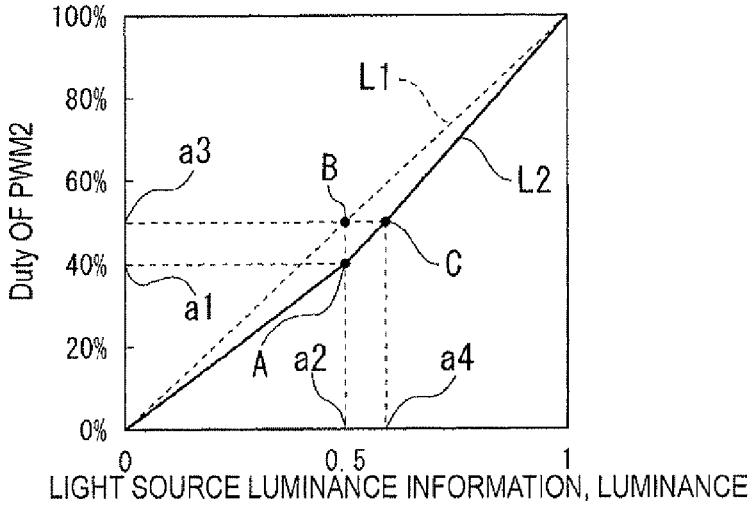
Figure 5C:
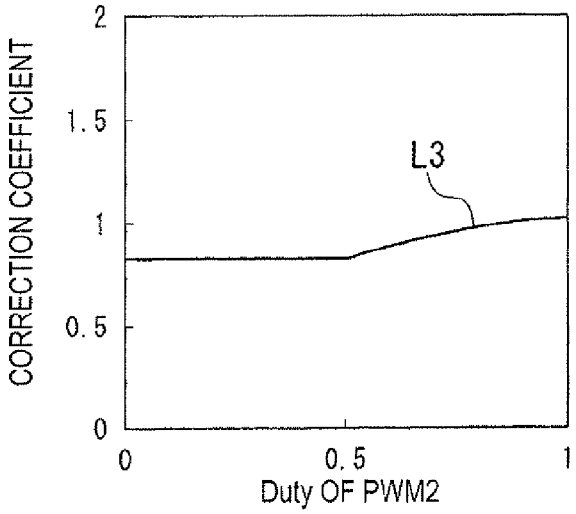

Subsequently, the correction coefficient calculation section 613 obtains the correction information using the [inflection-point Duty ratio] and the [inflection-point luminance] obtained in such a manner as described above. FIGS. 5A through 5C are graphs showing an example of a calculation process for obtaining a correction coefficient. FIGS. 5A through 5C are shown for the purpose of explanation, the graphical description is not required in the correction coefficient calculation section 613.

First, the correspondence relationship between the light source luminance information and the Duty ratio of PWM2 similar to the LUT used in the first calculation section 611 is expressed as a graph. FIG. 5A is a graph taking the normalized light source luminance information as the horizontal axis, and the Duty ratio of PWM2 as the vertical axis. Here, it is assumed that the luminance and the Duty ratio of PWM2 are in the relationship represented by the graph L1 having a linear shape. In FIG. 5A, the graph L1 is expressed by a dotted line.

The point representing the [inflection-point Duty ratio] (indicated by the symbol a1 in the drawing) and the [inflection-point luminance] (indicated by the symbol a2 in the drawing) obtained by the calculation described above is additionally drawn in the graph. For example, the point is shown as the point indicated by the symbol A.

Then, the linear interpolation is performed between the point indicated by the symbol A and the origin (0, 0%), and between the point indicated by the symbol A and a point (1, 100%) to thereby make a graph representing the corresponding relationship between the luminance in the case of performing the two modes of intermittent illumination and the Duty ratio of PWM2 (FIG. 5B). FIG. 5B is a graph taking the normalized luminance as the horizontal axis, and the Duty ratio of PWM2 as the vertical axis. For the purpose of comparison, FIG. 5B shows the graph L1 shown in FIG. 5A in an overlapping manner.

According to the graph thus obtained, the luminance and the Duty ratio are shown so as to have the relationship represented by the graph L2 taking the point indicated by the symbol A as an inflection point. In FIG. 5B, the graph L2 is expressed by a solid line.

For example, in the case of obtaining the Duty ratio of PWM2 on the LUT (corresponding to the graph L1) stored in the storage section 612 in order to obtain the luminance indicated by the symbol a2, the Duty ratio (indicated by the symbol a3 in the drawing) corresponding to the point B on the graph L1 is obtained. However, in the case of making the light source emit the light at the Duty ratio indicated by the symbol a3, the luminance (indicated by the symbol a4 in the drawing) corresponding to the point C on the graph L2 is actually obtained.

The luminance deviation caused in such a manner as described above can be resolved by correcting the Duty ratio indicated by the symbol a3 to the Duty ratio indicated by the symbol a1. In other words, the value obtained by dividing the Duty ratio indicated by the symbol a3 by the Duty ratio indicated by the symbol a1 corresponds to the correction coefficient (the correction information) for correcting the deviation.

Similarly, the correction coefficient is obtained in the entire range of the Duty ratio to thereby make the graph representing the relationship between the Duty ratio and the correction coefficient (FIG. 5C). According to the graph thus obtained, the Duty ratio obtained using the graph L1 and the correction coefficient of the Duty ratio thus obtained are shown so as to have the relationship represented by the graph L3.

The correction coefficient calculation section 613 calculates the correction information in such a manner as described above. The correspondence relationship represented by the graph L1 used for the calculation of the correction information is stored in the storage section 612. Further, the values such as the [$F_{ON}$ length] and the [$P_{ON}$ length] used for the calculation of the correction information are obtained from the frequencies of PWM1, PWM2, the Duty ratio thus set, and so on. Therefore, the correction coefficient calculation section 613 can obtain the appropriate correction information with a simple calculation in accordance with the image signal input thereto on a case-by-case basis.

The second calculation section 614 obtains the Duty ratio (the corrected Duty ratio), which is obtained by correcting the second Duty ratio, by calculation using the second Duty ratio obtained by the first calculation section 611 and the correction coefficient obtained by the correction coefficient calculation section 613. The calculation can be performed by, for example, multiplying the second Duty ratio obtained by the first calculation section 611 by the correction coefficient.

The second PWM signal generation section 632 generates PWM2 having the corrected Duty ratio using the corrected Duty ratio obtained by the second calculation section 614.

On the other hand, the intermittent lighting information input to the PWM signal generation section 63 is input to the first PWM signal generation section 631. The first PWM signal generation section 631 generates PWM1 having the first Duty ratio using the intermittent lighting information.

Further, the third calculation section 633 generates the composite pulse width modulation signal (the composite PWM signal) for driving the light source by, for example, taking the logical AND of PWM1 and PWM2. The composite PWM signal thus obtained is used for driving each of the light sources.

The projector 100 according to the present embodiment has the configuration described above.

According to the display device having the configuration described above, the drive condition of the intermittent illumination can easily be controlled without preparing the LUT with the luminance deviation corrected for each of the setting values of PWM1.

Further, according to the method of controlling the light source having the configuration described above, the control of the drive condition of the intermittent illumination becomes easy.

It should be noted that although in the present embodiment it is assumed that the frequency of PWM2 is an integral multiple of the frequency of PWM1, the invention is not limited to this configuration, but it is also possible to assume that there is adopted the configuration in which, for example, PWM2 is reset in sync with the rising edge of PWM1, and thus, the rising edge of PWM1 and the rising edge of PWM2 are in sync with each other.

Further, although in the present embodiment, it is assumed that there is adopted the configuration of generating the composite PWM signal by the logical AND operation in the condition in which PWM1 and PWM2 are generated in advance. It is also possible to adopt the configuration in which, for example, the composite PWM signal is generated using the rising timing of PWM1 as a trigger, and stopping the output of the composite PWM signal using the falling timing of PWM1 as a trigger.

Further, although in the present embodiment, the example of calculating the correction coefficient for the second Duty ratio by the second calculation section 614 in an explicit manner, the invention is not limited to this configuration. It is sufficient that the difference between the expected value of the luminance to be obtained and the setting value is corrected when generating the composite PWM signal, and it is also possible to arrange that, for example, the LUT is previously corrected using the correction information when looking up the LUT from the storage section 612, and then the corrected second Duty ratio, which has been corrected using the corrected LUT, namely the corrected Duty ratio is obtained. By adopting such a configuration, even in the case in which the light source luminance information is updated, it becomes possible to easily obtain the corrected Duty ratio only by looking up the LUT thus corrected without recalculating the correction information.

MODIFIED EXAMPLES

Further, although in the present embodiment, the explanation is presented assuming that the rising timing of PWM1 and the rising timing of PWM2 are in sync with each other, the invention is not limited to the phase relationship between PWM1 and PWM2.

First Modified Example

Figure 6:
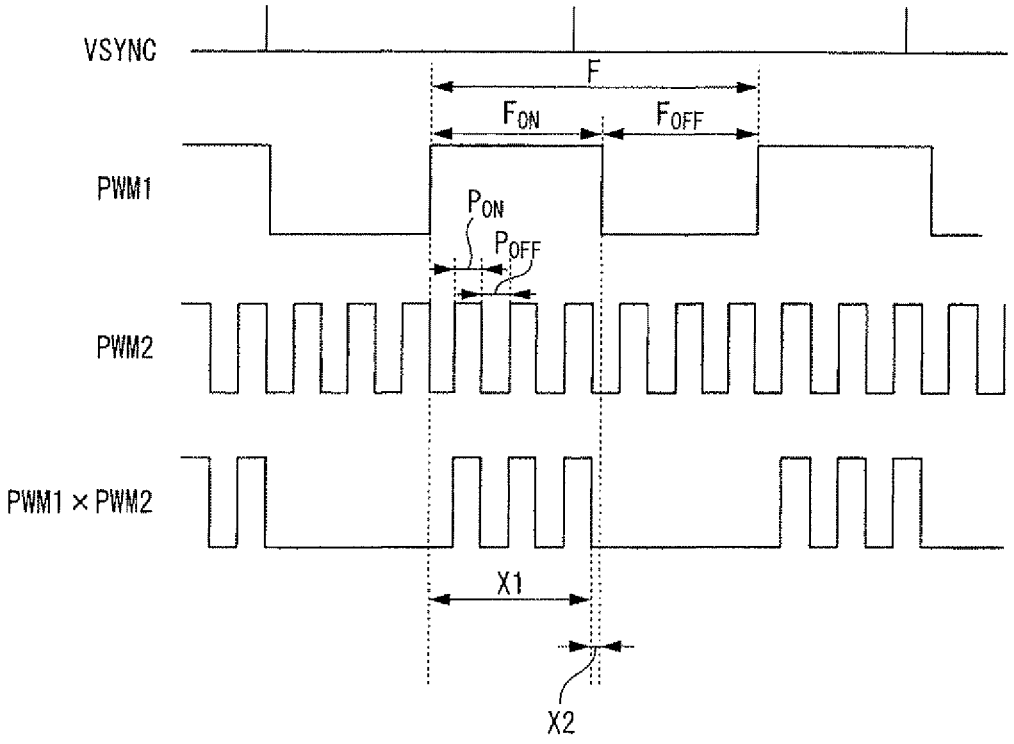
FIG. 6 is a timing chart of a projector according to a first modified example.

FIG. 6 is a timing chart in a first modified example of the projector according to the present embodiment, and corresponds to FIG. 3. In FIG. 6, the elements having the same definitions as those shown in FIG. 3 are denoted with the same reference symbols, and the detailed explanation thereof will be omitted.

As shown in the drawing, in the projector according to the present modified example, the rising timing of PWM1 and the falling timing of PWM2 are in sync with each other. In this case, unlike the configuration shown in FIG. 3, in the period X2, the pulse width modulation corresponding to the Duty ratio defined by PWM2 fails to be achieved, but an always-off state is set. As a result, as a whole of the lighting time $F_{ON}$, the pulse width modulation corresponding to the Duty ratio defined by PWM2 fails to be achieved, but the image darker than the setting is displayed.

Therefore, similarly to the projector 100 according to the embodiment described above, the correction coefficient is calculated in the PWM signal generation section 63 provided to the control section 6. On this occasion, unlike the projector 100 according to the embodiment described above, the [ON frequency] is obtained as a value obtained by rounding down the value (Formula (2) below), which is obtained by dividing the [$F_{ON}$ length] by the [X2 length], to an integer.

Figure 7A:
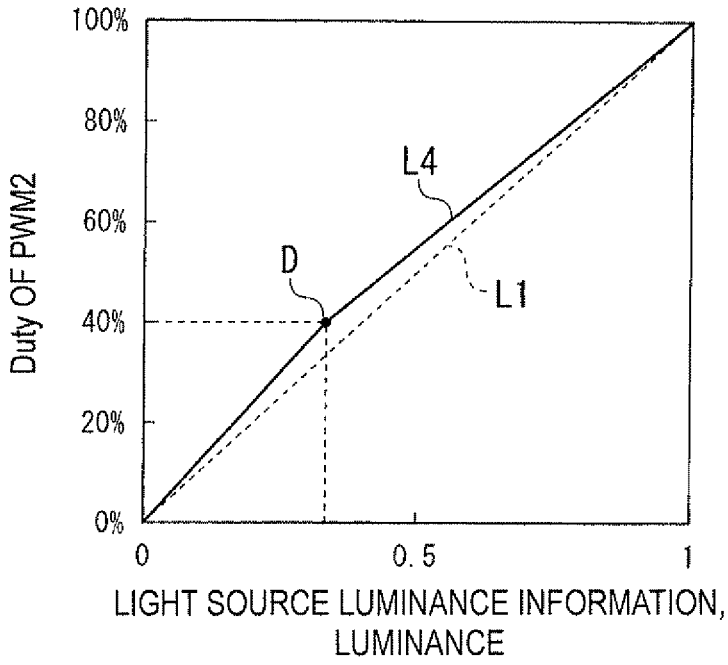
FIGS. 7A and 7B are graphs showing an example of a calculation process for obtaining a correction coefficient.
Figure 7B:
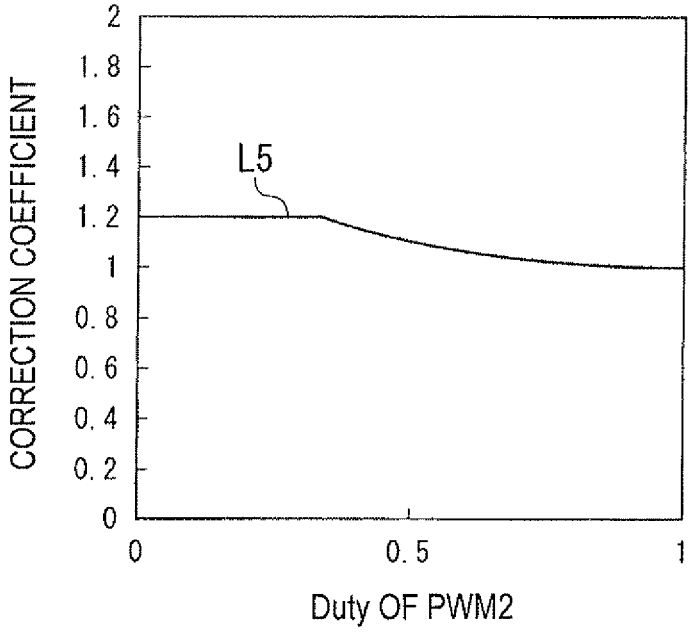

FIGS. 7A and 7B are graphs showing an example of a calculation process for obtaining a correction coefficient of the first modified example, and correspond respectively to FIGS. 5B and 5C.

As shown in FIG. 7A, in the first modified example, as a calculation result the correspondence relationship between the luminance and the Duty ratio of PWM2 is obtained so as to have the relationship represented by the graph L4 having the point indicated by the symbol D as an inflection point. As shown in the drawing, the graph L4 is a graph convex upward unlike the graph L2 described above.

Then, as shown in FIG. 7B, the correction coefficient is obtained in the entire range of the Duty ratio to thereby make the graph representing the relationship between the Duty ratio and the correction coefficient. According to the graph thus obtained, the Duty ratio obtained using the graph L1 and the correction coefficient of the Duty ratio thus obtained are shown so as to have the relationship represented by the graph L5.

In the projector according to the first modified example, it is possible to obtain PWM2 using the correction coefficient expressed as the graph L5, and generate the composite PWM signal to thereby perform the dimming control.

Second Modified Example

Figure 8:
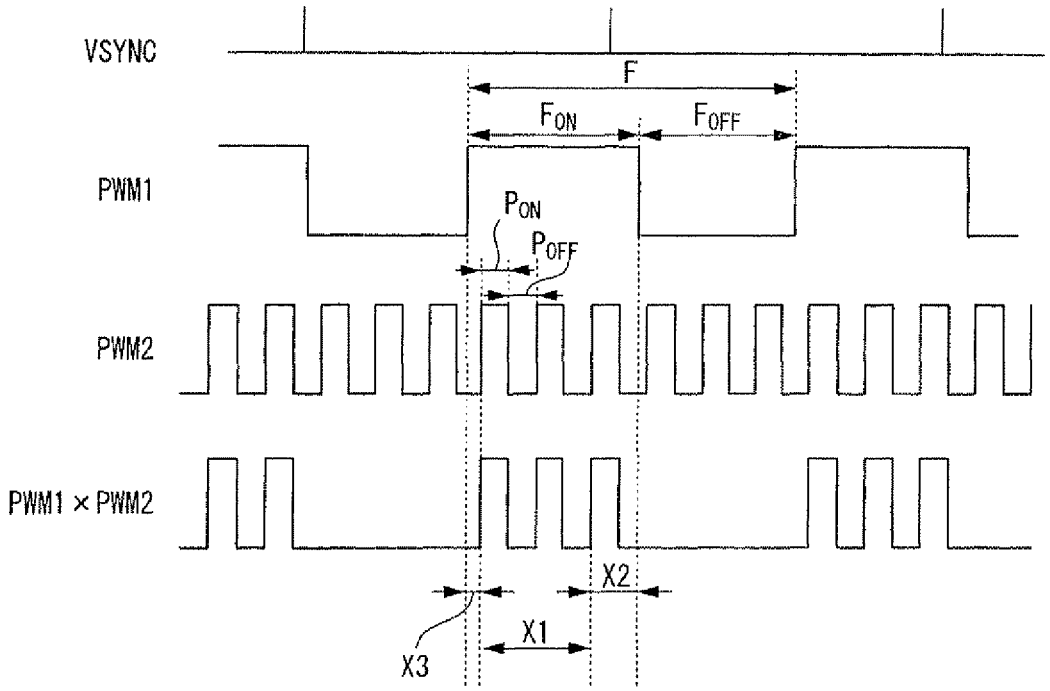
FIG. 8 is a timing chart of a projector according to a second modified example.

FIG. 8 is a timing chart in a second modified example of the projector according to the present embodiment, and corresponds to FIG. 3. In FIG. 8, the elements having the same definitions as those shown in FIG. 3 are denoted with the same reference symbols, and the detailed explanation thereof will be omitted.

As shown in the drawing, in the projector according to the present modified example, the rising timing and the falling timing of PWM1 and the rising timing and the falling timing of PWM2 fail to be in sync with each other, and the phases are shifted from each other. In FIG. 8, PWM2 is set to the OFF state at both of the rising timing and the falling timing of PWM1 In this case, unlike the configuration shown in FIG. 3, the correction coefficient is obtained taking also a period X3 corresponding to the phase shift preceding the period X1 into consideration in addition to the period X2 following the period X1.

It should be noted that it is assumed that the phase shift time is a known value, and the length of the period X3 is a constant.

In the projector driven in accordance with such a timing chart as shown in FIG. 8, the change in luminance corresponding to the inflection point described above can occur in a first state in which the falling timing of PWM1 and the falling timing of PWM2 coincide with each other at the end of the period X2, and a second state in which the rising timing of PWM1 and the falling timing of PWM2 coincide with each other at the beginning of the period X3. In the following explanation, the inflection point corresponding to the first state may be referred to as a "first inflection point," and the inflection point corresponding to the second state may be referred to as a "second inflection point."

The luminance changes corresponding to the first inflection point and the second inflection point will be explained in further detail using FIGS. 9A, 9B, 10A, and 10B. FIGS. 9A, 9B, 10A, and 10B are enlarged diagrams of the timing charts in the case in which the first inflection point or the second inflection point occurs.

Assuming the case of gradually decreasing the Duty ratio of PWM2 from 100%, two cases shown respectively in FIGS. 9A and 9B, and FIGS. 10A and 10B are possible.

Figure 9A:
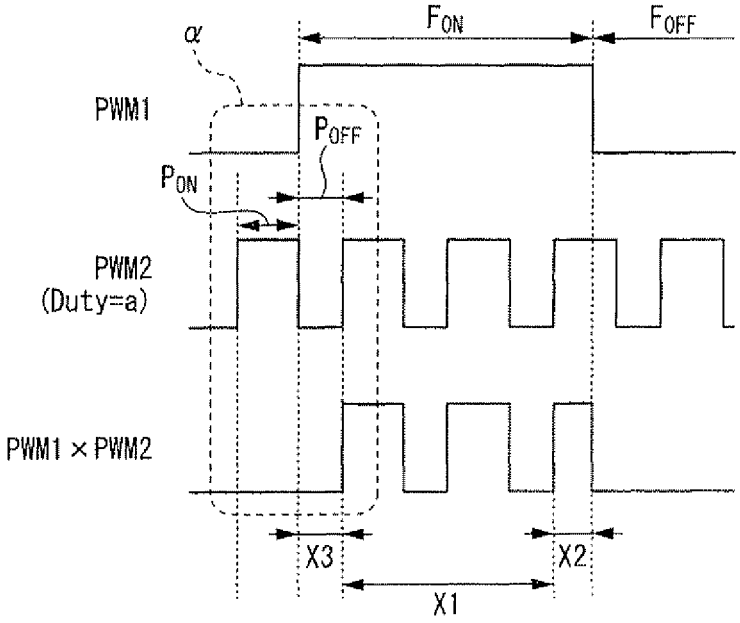
FIGS. 9A and 9B are timing charts of the projector according to the second modified example.
Figure 9B:
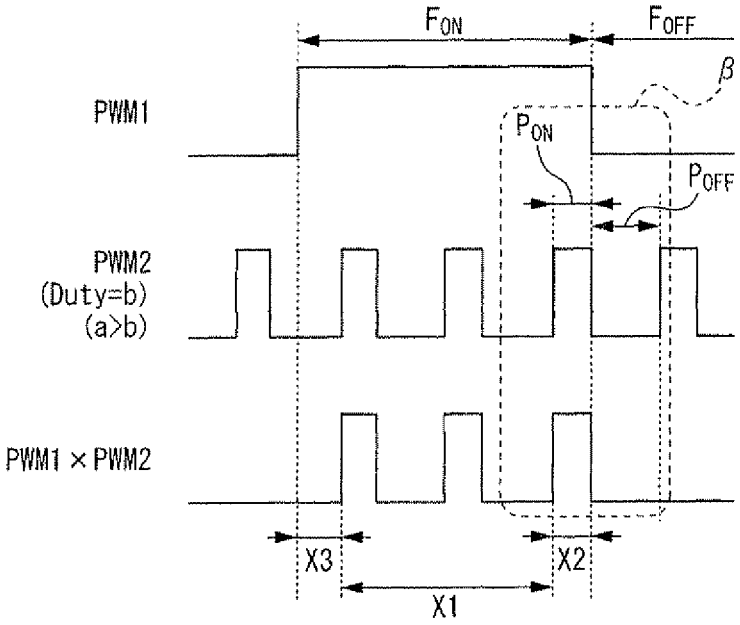

Firstly, as a first case, in FIG. 9A, the second state in which the rising timing of PWM1 and the falling timing of PWM2 coincide with each other at the beginning of the period X3 occurs when the Duty ratio of PWM2 is equal to "a." Further, in FIG. 9B, the first state in which the falling timing of PWM1 and the falling timing of PWM2 coincide with each other at the end of the period X2 occurs when the Duty ratio of PWM2 is equal to "b" (assuming a>b).

Figure 10A:
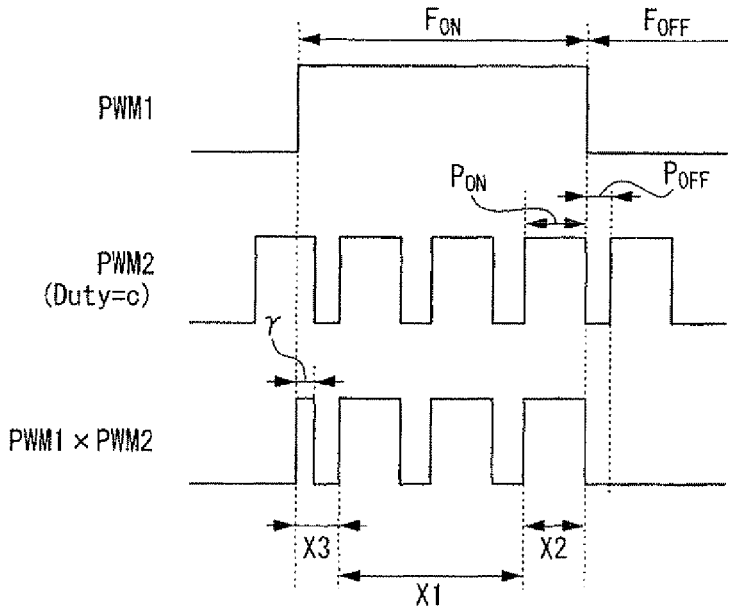
FIGS. 10A and 10B are timing charts of the projector according to the second modified example.
Figure 10B:
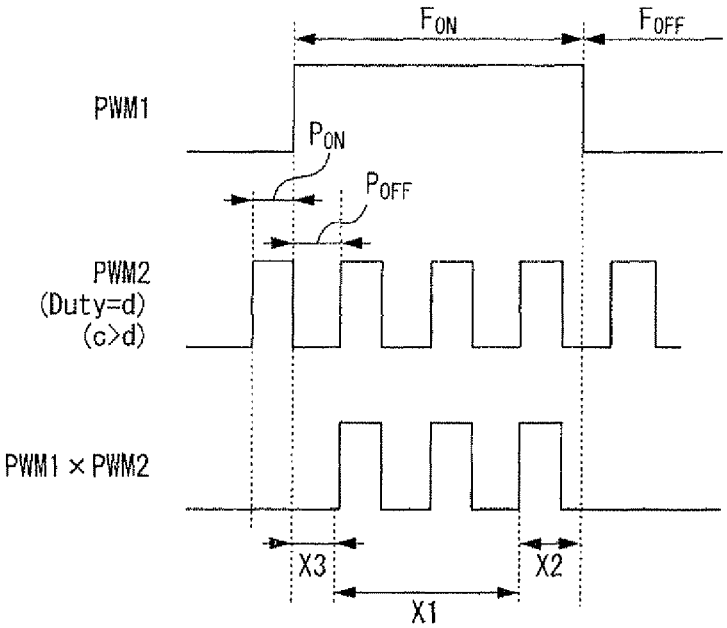

Further, as a second case, in FIG. 10A, the first state in which the falling timing of PWM1 and the falling timing of PWM2 coincide with each other at the end of the period X2 occurs when the Duty ratio of PWM2 is equal to "c." Further, in FIG. 10B, the second state in which the rising timing of PWM1 and the falling timing of PWM2 coincide with each other at the beginning of the period X3 occurs when the Duty ratio of PWM2 is equal to "d" (assuming c>d).

In either of the first and second cases, similarly to the projector 100 according to the embodiment described above, the correction coefficient is calculated in the PWM signal generation section 63 provided to the control section 6. In the calculation of the correction coefficient, the inflection point is obtained first.

The coordinate (luminance, Duty ratio) of the inflection point is obtained in the following manner.

First Case

In the first case, the Duty ratio at the second inflection point (a second inflection-point Duty ratio) is obtained focusing attention on the part indicated by the symbol α in FIG. 9A. Specifically, the [second inflection point Duty ratio] is equal to the Duty ratio at which the length [$P_{OFF}$ length] of the OFF period $P_{OFF}$ coincides with the "length of the period X3" (hereinafter referred to as X3 length). Since the [$P_{ON}$ length] is equal to the value obtained by subtracting the [$P_{OFF}$ length] from the [PWM2 length], the [second inflection-point Duty ratio] can be obtained by Formula (6) below.

$$\text{Second inflection-point Duty ratio} = \frac{[PWM2\ \text{period}] - [P_{OFF}\ \text{length}]}{PWM2\ \text{period}} = 1 - \frac{X3\ \text{length}}{PWM2\ \text{period}} \tag{6}$$

Further, the [virtual PWM Duty ratio], which is the Duty ratio in the lighting time $F_{ON}$, can be obtained by Formula (7) below.

$$\text{Virtual } PWM \text{ Duty ratio} = \frac{ON\ \text{total}}{F_{ON}\ \text{length}} = \frac{[P_{ON}\ \text{length}] \times [ON\ \text{frequency}] + [\text{first inflection-point Duty ratio}] \times [PWM2\ \text{period}]}{F_{ON}\ \text{length}} \tag{7}$$

In this case, the [ON frequency] is obtained by rounding up the value of Formula (8) below to an integer similarly to Formula (2) described above based on the length obtained by disregarding the phase shift period (the period X3) in the length of the lighting time $F_{ON}$.

$$ON \text{ frequency} = \frac{[F_{ON} \text{ length}] - [X3 \text{ length}]}{PWM2 \text{ period}} \quad (8)$$

Further, the luminance at the second inflection point (hereinafter referred to as second inflection-point luminance) corresponds to the product of the [virtual PWM Duty ratio] and the light source output, and can therefore be obtained by Formula (9) below.

$$\text{Second inflection-point luminance} = [\text{virtual PWM Duty ratio}] \times [\text{light source output}] \quad (9)$$

It should be noted that the [first inflection-point Duty ratio] in Formula (7) is obtained in the following manner.

In the first case, the Duty ratio at the first inflection point (a first inflection-point Duty ratio) is obtained focusing attention on the part indicated by the symbol β in FIG. 9B. Specifically, the Duty ratio to be obtained is equal to the Duty ratio at which the [$P_{ON}$ length] coincides with the period X2. Therefore, the [X2 length] is obtained first as the remainder of Formula below, and then the [first inflection-point Duty ratio] is obtained by Formula (11) below.

$$X2 \text{ length} = \frac{[F_{ON} \text{ length}] - [X3 \text{ length}]}{PWM2 \text{ period}} \quad (10)$$

$$\text{First inflection-point Duty ratio} = \frac{X2 \text{ length}}{PWM2 \text{ period}} \quad (11)$$

Further, the luminance at the first inflection point (a first inflection-point luminance) can be obtained in a similar manner to Formulas (2) through (4).

Second Case

In the second case, the [first inflection-point Duty ratio] is equal to the Duty ratio at which the [$P_{ON}$ length] coincides with the [X2 length], and is therefore obtained using Formulas (10) and (11) similarly to the calculation of the Duty ratio at the first inflection point in the first case.

Further, regarding the [first inflection-point luminance], the composite PWM Duty ratio is obtained first based on the sum of the total amount of the ON periods $P_{ON}$ in the periods X1, X2 and the ON period in the period X3 indicated by the symbol γ in FIG. 10A (Formulas (12) through (14) below). Then, the [first inflection-point luminance] is obtained by multiplying the composite PWM Duty ratio by the light source output (Formula (15) below). The [second inflection-point Duty ratio] in the formula will be described later.

$$ON \text{ period in } X1, X2 = [ON \text{ length}] \times [ON \text{ frequency}] \quad (12)$$

$$ON \text{ period in } X3 = \left( \begin{array}{l} [\text{first inflection-point Duty ratio}] - \\ [\text{second inflection-point Duty ratio}] \end{array} \right) \times [PWM2 \text{ period}] \quad (13)$$

$$\text{Composite } PWM \text{ Duty ratio} = \frac{ON \text{ total}}{F_{ON} \text{ length}} = \frac{[ON \text{ period in } X1, X2] + [ON \text{ period in } X3]}{F_{ON} \text{ length}} \quad (14)$$

$$\text{First inflection-point luminance} = [\text{composite PWM Duty ratio}] \times [\text{light source output}] \quad (15)$$

It should be noted that the [ON frequency] is obtained by rounding up the value of Formula (8) to an integer.

In the second case, the [second inflection-point Duty ratio] is equal to the Duty ratio at which the [$P_{OFF}$ length] coincides with the [X3 length], and can therefore be obtained by Formula (6) described above.

Further, the [second inflection-point luminance] can be obtained in a similar manner to Formulas (2) through (4).

Figure 11A:
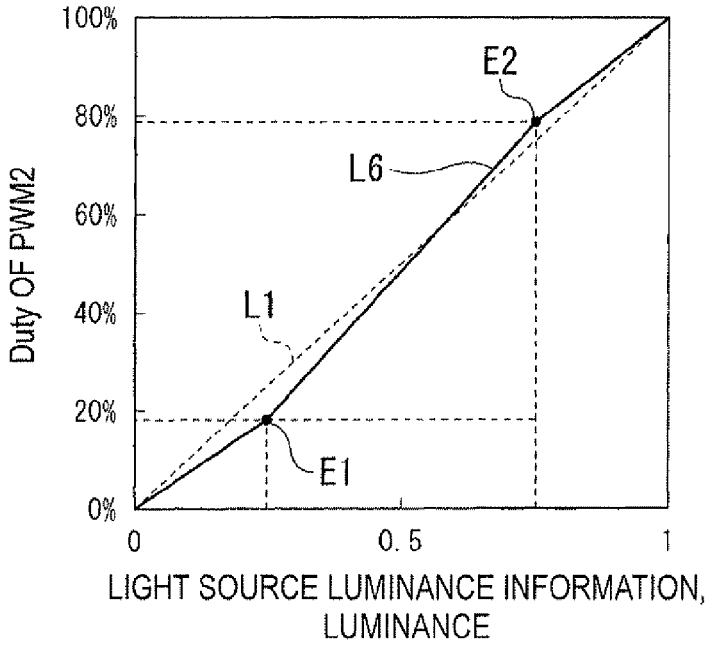
FIGS. 11A and 11B are graphs showing an example of a calculation process for obtaining a correction coefficient.
Figure 11B:
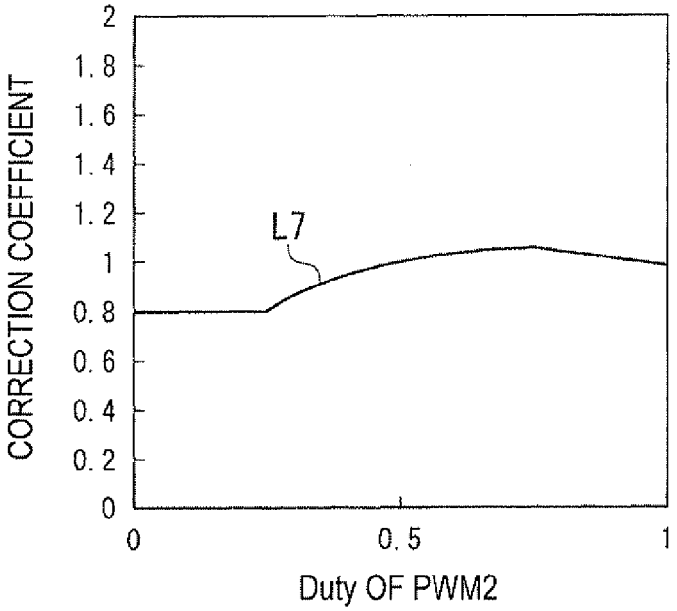

FIGS. 11A and 11B are graphs showing an example of a calculation process for obtaining a correction coefficient of the second modified example, and correspond respectively to FIGS. 7A and 7B. Firstly, as shown in FIG. 11A, linear interpolation is performed between (a) the two inflection points, (b) the origin (0, 0%) and closer one of the two inflection points to the origin, and (c) the point (1, 100%) and closer one of the two inflection points to the point (1, 100%) using the first inflection point and the second inflection point obtained by the calculation described above. Thus, with respect to the correspondence relationship between the luminance and the Duty ratio of PWM2, the graph L6 having the first inflection point indicated by the symbol E1 and the second inflection point indicated by the symbol E2 is made.

Then, as shown in FIG. 11B, the correction coefficient is obtained in the entire range of the Duty ratio to thereby make the graph representing the relationship between the Duty ratio and the correction coefficient. According to the graph thus obtained, the Duty ratio obtained using the graph L1 and the correction coefficient of the Duty ratio thus obtained are shown so as to have the relationship represented by the graph L7.

In the projector according to the second modified example, it is possible to obtain PWM2 using the correction coefficient expressed as the graph L7, and generate the composite PWM signal to thereby perform the dimming control.

Although the explanation is hereinabove presented regarding the preferable embodiment of the invention with reference to the accompanying drawings, it is obvious that the invention is not limited to the embodiment described above. The various shapes and combinations of the components presented in the embodiment described above are illustrative only, and can variously be modified within the spirit or the scope of the invention in accordance with design needs and so on.

For example, although in the embodiment described above, the example in which the PWM signal is commonly applied to the first light source, the second light source, and the third light source is described, the invention is not limited to this configuration, but the PWM signals different from each other can respectively be applied to the light sources. For example, by setting the LUT representing the relationship between the light source luminance information and the Duty ratio in accordance with the characteristics of each of the light sources, the preferable white balance can be maintained even when dimming the light. Further, by setting the luminance different between the light sources for each of the color modes, the desired white balance can be realized.

What is claimed is:

1. A display device comprising:

a light source; and a control section adapted to generate a composite pulse width modulation signal using a first pulse width modulation signal having a first duty ratio and a second pulse width modulation signal having a frequency higher than a frequency of the first pulse width modulation signal, and control a light emitting state of the light source using the composite pulse width modulation signal, wherein the control section corrects a second duty ratio, which is obtained based on a correspondence relationship between information related to luminance of the light source and a duty ratio of a pulse width modulation signal of the light source, based on a difference between an expected value of luminance obtained when making the light source emit light using a virtual pulse width modulation signal, which is obtained by combining the first pulse width modulation signal and a pulse width modulation signal having the second duty ratio, and a setting value of luminance based on the information related to the luminance of the light source, and the control section obtains a corrected second duty ratio as a duty ratio of the second pulse width modulation signal.

2. The display device according to claim 1, wherein the light source includes a first light source and a second light source, and the control section performs a calculation of correcting a difference in light source output between the first light source and the second light source in a case of making the first light source and the second light source emit light in a same condition.

3. The display device according to claim 1, wherein the frequency of the second pulse width modulation signal is an integral multiple of the frequency of the first pulse width modulation signal.

4. The display device according to claim 1, wherein the control section obtains the second duty ratio using a look-up table representing the correspondence relationship.

5. The display device according to claim 1, wherein the control section calculates correction information adapted to correct a difference between the expected value and the setting value using the first duty ratio and the second duty ratio, and corrects the second duty ratio using the correction information.

6. The display device according to claim 4, wherein the control section calculates correction information adapted to correct a difference between the expected value and the setting value using the first duty ratio and the second duty ratio, corrects the look-up table using the correction information, and obtains a duty ratio of the second pulse width modulation signal, which is the corrected second duty ratio, using a corrected look-up table.

7. A method of controlling a light source adapted to control a light emitting state of the light source using a composite pulse width modulation signal, which is generated using a first pulse width modulation signal having a first duty ratio and a second pulse width modulation signal having a frequency higher than a frequency of the first pulse width modulation signal, the method comprising:

obtaining a second duty ratio based on a correspondence relationship between information related to luminance of the light source and a duty ratio of a pulse width modulation signal of the light source;

obtaining a virtual pulse width modulation signal by combining the first pulse width modulation signal and a pulse width modulation signal having the second duty ratio;

correcting the second duty ratio based on a difference between an expected value of luminance obtained when making the light source emit light using the virtual pulse width modulation signal and a setting value of luminance based on the information related to the luminance of the light source; and obtaining a corrected second duty ratio as a duty ratio of the second pulse width modulation signal.

* * * * *